US009898948B2

(12) United States Patent
Lim et al.

(10) Patent No.: US 9,898,948 B2
(45) Date of Patent: Feb. 20, 2018

(54) DATA DRIVER AND DISPLAY DEVICE HAVING THE SAME

(71) Applicant: SAMSUNG DISPLAY CO., LTD., Yongin, Gyeonggi-Do (KR)

(72) Inventors: Hyun-Ho Lim, Jecheon-si (KR); Jin-Woo Kim, Hwaseong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 163 days.

(21) Appl. No.: 14/725,926

(22) Filed: May 29, 2015

(65) Prior Publication Data

US 2016/0148599 A1 May 26, 2016

(30) Foreign Application Priority Data

Nov. 25, 2014 (KR) ..... 10-2014-0164961

(51) Int. Cl.
*G09G 5/18* (2006.01)
*G09G 3/20* (2006.01)

(52) U.S. Cl.
CPC ..... *G09G 3/20* (2013.01); *G09G 2300/0452* (2013.01); *G09G 2310/0275* (2013.01); *G09G 2310/0297* (2013.01); *G09G 2320/0204* (2013.01); *G09G 2320/0223* (2013.01)

(58) Field of Classification Search
None
See application file for complete search history.

(56) References Cited

U.S. PATENT DOCUMENTS

2002/0089485 A1* 7/2002 Youn ..... G09G 3/3614 345/99
2012/0206506 A1* 8/2012 Kim ..... G09G 3/20 345/690
2015/0109356 A1* 4/2015 Yata ..... G09G 3/2003 345/691

FOREIGN PATENT DOCUMENTS

KR 10-2009-0009640 A 1/2009
KR 10-2009-0037695 A 4/2009
KR 10-2011-0030212 A 3/2011
KR 10-2011-0058680 A 6/2011

* cited by examiner

*Primary Examiner* — Tony N Ngo
(74) *Attorney, Agent, or Firm* — Lee & Morse, P.C.

(57) ABSTRACT

A display device includes a display panel, a scan driver, a first data driver, a second data driver, and a timing controller. The display panel includes a plurality of pixels. The scan driver supplies scan signals to the pixels. The first data driver is connected to first ends of data lines and supplies data voltages to the pixels through the data lines during an active period of the scan signals. The second data driver is connected to second ends of the data lines and supplies the data voltages to the pixels through the data lines during the active period of the scan signals. The timing controller controls the scan driver and the first and second data drivers. The first and second data drivers swap at least two of the data voltages based on a swap control signal.

18 Claims, 4 Drawing Sheets

DATA DRIVER AND DISPLAY DEVICE HAVING THE SAME

CROSS-REFERENCE TO RELATED APPLICATION

Korean Patent Application No. 10-2014-0164961, filed on Nov. 25, 2014, in the Korean Intellectual Property Office, and entitled: "Data Driver and Display Device Having The Same," is incorporated by reference herein in its entirety.

BACKGROUND

1. Field

Example embodiments relate generally to electronic devices. More particularly, embodiments relate to data drivers and display devices having the data driver.

2. Description of the Related Art

A data driver may generate data voltages based on image data and supply the data voltages to a display panel. In detail, the data driver may supply the data voltages to pixels included in the display panel through data lines. As a result, the pixels may emit light based on the supplied data voltages. In contrast with an ideal data line, an actual data line may have resistance. Therefore, the resistance on the actual data line may cause a delay in a charging time in which the pixels have a certain voltage level to emit light. The resistance of the data line is proportional to a length of the data line. As a size of the display panel increases, the length of the data line increases. Therefore, an increase in the size of the display panel causes an increase on the charging time of the data voltages.

SUMMARY

According to an aspect of example embodiments, a display device may include a display panel including a plurality of pixels, a scan driver to supply scan signals to the pixels, a first data driver connected to first ends of data lines and to supply data voltages to the pixels through the data lines during an active period of the scan signals, a second data driver connected to second ends of the data lines and to supply the data voltages to the pixels through the data lines during the active period of the scan signals, and a timing controller to control the scan driver, the first data driver, and the second data driver. The first data driver and the second data driver may be to swap at least two of the data voltages based on a swap control signal and supply the swapped data voltages to the data lines.

In example embodiments, each of the first and second data drivers may include a data voltage generator to generate the data voltages, and a data voltage swapper to swap the data voltages based on the swap control signal and supply the swapped data voltages to the data lines.

In example embodiments, the data lines may include first through n-th data lines adjacent to each other, and the data voltage swapper may be to swap the at least two of the data voltages based on the swap control signal and to supply the swapped data voltages to the first through n-th data lines, where n is an integer greater than or equal to 2.

In example embodiments, the data voltage swapper may be to swap a k-th data voltage supplied to a k-th data line with an (n−k+1)-th data voltage supplied to an (n−k+1)-th data line among the data voltages, where k is a positive integer less than or equal to n.

In example embodiments, the data lines may include a first data line, a second data line and a third data line between the first data line and the second data line, and the data voltage swapper may be to swap a first data voltage supplied to the first data line with a second data voltage supplied to the second data line among the data voltages based on the swap control signal.

In example embodiments, the first data line may be connected to a red pixel emitting red light, the second data line is connected to a blue pixel emitting blue light, and the third data line may be connected to a green pixel emitting green light.

In example embodiments, the data voltage swapper may include a first swap transistor including a gate terminal to receive the swap control signal, a first terminal to receive the first data voltage, and a second terminal connected to the first data line, a second swap transistor including a gate terminal to receive the swap control signal, a first terminal to receive the first data voltage, and a second terminal connected to the second data line, a third swap transistor including a gate terminal to receive the swap control signal, a first terminal to receive the second data voltage, and a second terminal connected to the second data line, and a fourth swap transistor including a gate terminal to receive the swap control signal, a first terminal to receive the second data voltage, and a second terminal connected to the first data line.

In example embodiments, the first and third swap transistors may be N-channel Metal Oxide Semiconductor (NMOS) transistors, and the second and fourth swap transistors may be P-channel Metal Oxide Semiconductor (PMOS) transistors.

In example embodiments, the first and third swap transistors may be turned-on and the second and fourth swap transistors may be turned-off when the swap control signal has a first voltage level, and the first and third swap transistors may be turned-off and the second and fourth swap transistors may be turned-on when the swap control signal has a second voltage level lower than the first voltage level.

In example embodiments, the data lines may include a first data line, a second data line, a third data line, and a fourth data line adjacent to each other. The data voltage swapper may be to swap a first data voltage supplied to the first data line with a fourth data voltage supplied to the fourth data line among the data voltages based on the swap control signal. The data voltage swapper may be to swap a second data voltage supplied to the second data line with a third data voltage supplied to the third data line among the data voltages based on the swap control signal.

In example embodiments, the first data line may be connected to a red pixel emitting red light, the second data line may be connected to a green pixel emitting green light, the third data line may be connected to a blue pixels emitting blue light, and the fourth data line may be connected to a white pixel emitting white light.

In example embodiments, the data lines may include a first data line and a second data line adjacent to each other. The data voltage swapper may be to swap a first data voltage supplied to the first data line with a second data voltage supplied to the second data line among the data voltages based on the swap control signal.

In example embodiments, the first data line may be connected to a red pixel emitting red light and a blue pixel emitting blue light, and the second data line may be connected to a green pixel emitting green light.

In example embodiments, the data voltage generator may be to generate the data voltages by selecting one of candidate data voltages.

In example embodiments, the candidate data voltages may include a red activation voltage, a green activation voltage, a blue activation voltage, and a deactivation voltage.

In example embodiments, the candidate data voltages may include a pre-emphasis voltage to reduce a required time in which the red activation voltage, the green activation voltage, and the blue activation voltage are supplied to the pixels.

According to an aspect of example embodiments, a data driver may include a data voltage generator to generate data voltages, and a data voltage swapper to swap the data voltages based on a swap control signal and to supply the swapped data voltages to data lines.

In example embodiments, the data lines may include first through n-th data lines adjacent to each other, and the data voltage swapper may be to swap at least two of the data voltages based on the swap control signal and to supply the swapped data voltages to the first through n-th data lines, where n is an integer greater than or equal to 2.

In example embodiments, the data voltage swapper may be to swap a k-th data voltage supplied to a k-th data line with an (n−k+1)-th data voltage supplied to an (n−k+1)-th data line among the data voltages, where k is a positive integer less than or equal to n.

In example embodiments, the data lines may include a first data line, a second data line and a third data line between the first data line and the second data line, and the data voltage swapper may be to swap a first data voltage supplied to the first data line with a second data voltage supplied to the second data line among the data voltages based on the swap control signal.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
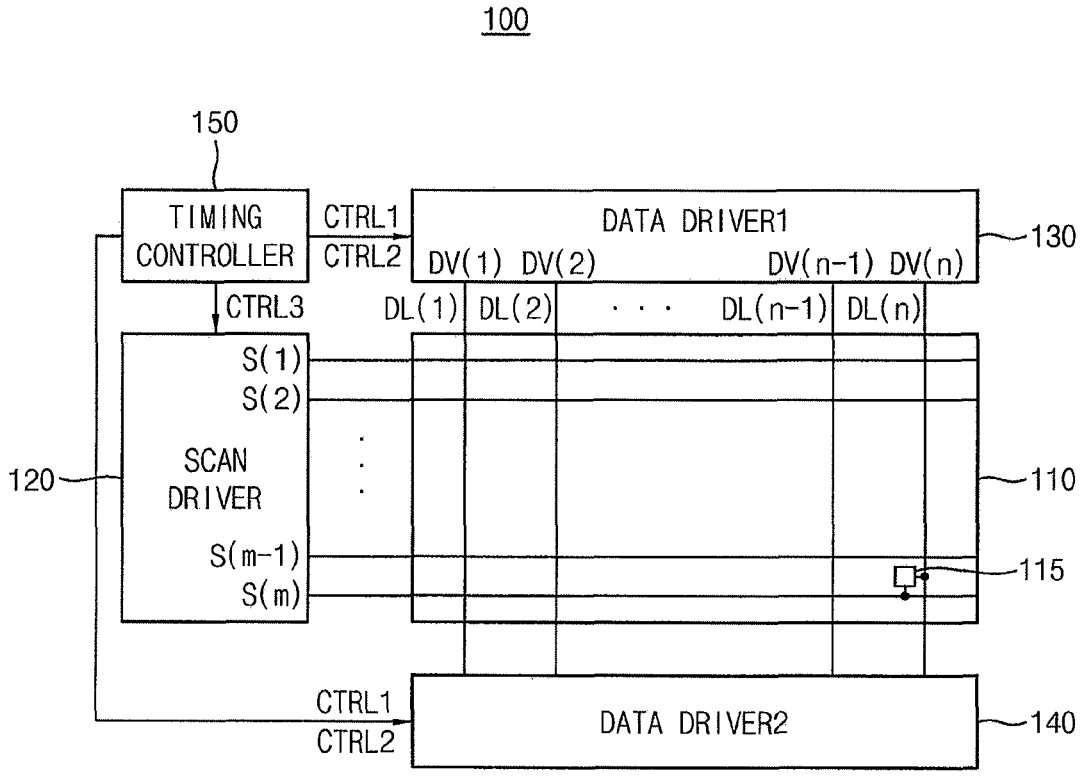
FIG. 1 illustrates a block diagram of a display device according to example embodiments.

FIG. 1 illustrates a block diagram of a display device according to example embodiments. Referring to FIG. 1, the display device 100 may include a display panel 110, a scan driver 120, a first data driver 130, a second data driver 140, and a timing controller 150.

The display panel 110 may include a plurality of pixels 115. The pixels 115 may receive data voltages DV(1) through DV(n). The pixels 115 may emit light based on the supplied data voltages DV(1) through DV(n). In an example embodiment, the pixels 115 may include a red pixel emitting red light, a green pixel emitting green light, and a blue pixel emitting blue light. In another example embodiment, the pixels 115 may include the red pixel emitting red light, the green pixel emitting green light, the blue pixel emitting blue light and a white pixel emitting white light.

The scan driver 120 may supply scan signals S(1) through S(m) to the pixels 115. The scan signals may be signals that alternate between active and inactive periods. The timing controller 150 may control start and end timings of the each active period. The pixels 115 may receive the data voltages DV(1) through DV(n) during the active period of the scan signals S(1) through S(m). That is, one of the pixels 115 may receive a target data voltage among the data voltages DV(1) through DV(n) by controlling the active period of the scan signals S(1) through S(m).

The first data driver 130 may be connected to first ends of data lines DL(1) through DL(n). The first data driver 130 may supply the data voltages DV(1) through DV(n) to the pixels 115 through the data lines DL(1) through DL(n) during the active period of the scan signals S(1) through S(m).

The second data driver 140 may be connected to second ends of the data lines DL(1) through DL(n). The second data driver 140 may supply the data voltages DV(1) through DV(n) to the pixels 115 through the data lines DL(1) through DL(n) during the active period of the scan signals S(1) through S(m).

The first data driver 130 and the second data driver 140 may swap at least two of the data voltages DV(1) through DV(n) based on a swap control signal CTRL2 and supply the swapped data voltages to the data lines DL(1) through DL(n).

In some example embodiments, each of the first and second data drivers may include a data voltage generator and a data voltage swapper (discussed in more detail below in connection with FIG. 2). The data voltage generator may generate the data voltages DV(1) through DV(n). In some embodiments, the display device 100 may be driven by a digital driving technique. In detail, the data voltage generator may generate the data voltages DV(1) through DV(n) based on a data control signal CTRL1. The data voltage swapper may swap the data voltages DV(1) through DV(n) based on the swap control signal CTRL2 and supply the swapped data voltages to the data lines DL(1) through DL(n). For example, the data voltage generator may generate the data voltages of about 1V, about 3V, about 5V, and about 7V corresponding to pixels each emitting different color lights. The data voltage swapper may swap the data voltage of about 3V with the data voltage of about 5V based on a first logic level of the swap control signal CTRL2 and supply the swapped data voltages to the data lines DL(1) through DL(n). The data voltage swapper may not swap the data voltages based on a second logic level of the swap control signal CTRL2 and supply the data voltage of about 3V and the data voltage of about 5V to the data lines DL(1) through DL(n).

Moreover, the data voltage swapper may swap at least three data voltages DV(1) through DV(n). For example, the data voltage generator may generate the data voltages DV(1) through DV(n) to have one of about 1V, about 3V, about 5V, and about 7V. The data voltages DV(1) through DV(n) may be applied to the data lines DL(1) through DL(n). The data voltage swapper may swap the data voltage of about 3V, the data voltage of about 5V, and the data voltage of about 7V when the swap control signal CTRL2 has the first logic level, and may supply the swapped data voltages to the data lines DL(1) through DL(n). The data voltage swapper may not swap the data voltages when the swap control signal CTRL2 has the second logic level, and may supply the data voltage of about 3V, the data voltage of about 5V, and the data voltage of about 7V to the data lines DL(1) through DL(n).

The data voltage swapper included in the first data driver 130 may be operated differently with the data voltage swapper included in the second data driver 140 to supply substantially the same data voltages DV(1) through DV(n) to the both ends of the data lines DL(1) through DL(n). For example, the data voltage swapper included in the first data driver 130 may not perform a swap operation and the data voltage swapper included in the second data driver 140 may perform the swap operation, therefore, both ends of the data lines DL(1) through DL(n) may receive substantially the same data voltages DV(1) through DV(n), respectively. In other words, when the first data driver 130 performs a swap operation, the second data driver 140 does not, and vice versa.

In some example embodiments, the data lines DL(1) through DL(n) may include first through n-th data lines adjacent to each other, where n is an integer greater than or equal to 2. The data voltage swapper may swap at least two of the data voltages DV(1) through DV(n) based on the swap control signal CTRL2 and supply the swapped data voltages to the first through n-th data lines.

In example embodiments, the data voltage swapper may swap a k-th data voltage supplied to a k-th data line with an (n−k+1)-th data voltage supplied to an (n−k+1)-th data line among the data voltages DV(1) through DV(n), where k is a positive integer less than or equal to n. For example, the data lines DL(1) through DL(n) may include first through fifth data lines adjacent to each other. Here, the data voltage swapper may swap a first data voltage supplied to a first data line with a fifth data voltage supplied to a fifth data line. The data voltage swapper may swap a second data voltage supplied to a second data line with a fourth data voltage supplied to a fourth data line. The data voltage swapper may not swap a third data voltage supplied to a third data line, i.e., may supply the third data voltage to the third data line.

In some example embodiments, the data lines DL(1) through DL(n) may include a first data line, a second data line, and a third data line between the first data line and the second data line. Here, the data voltage swapper may swap a first data voltage supplied to the first data line with a second data voltage supplied to the second data line among the data voltages DV(1) through DV(n) based on the swap control signal CTRL2. The data voltage swapper may not swap a third data voltage supplied to the third data line among the data voltages DV(1) through DV(n), i.e., may supply the third data voltage to the third data line. In an example embodiment, the first data line may be connected to a red pixel emitting red light, the second data line may be connected to a blue pixel emitting blue light, and the third data line may be connected to a green pixel emitting green light. In another example embodiment, the first data line may be connected to the green pixel emitting green light, the second data line may be connected to the red pixel emitting red light, and the third data line may be connected to the blue pixel emitting blue light. In still another example embodiment, the first data line may be connected to the blue pixel emitting blue light, the second data line may be connected to the green pixel emitting green light, and the third data line may be connected to the red pixel emitting red light.

In some example embodiments, the data voltage swapper may include a first swap transistor, a second swap transistor, a third swap transistor, and a fourth swap transistor. The first swap transistor may include a gate terminal to receive the swap control signal CTRL2, a first terminal to receive the first data voltage, and a second terminal connected to the first data line. The second swap transistor may include a gate terminal to receive the swap control signal CTRL2, a first terminal to receive the first data voltage, and a second terminal connected to the second data line. The third swap transistor may include a gate terminal to receive the swap control signal CTRL2, a first terminal to receive the second data voltage, and a second terminal connected to the second data line. The fourth swap transistor may include a gate terminal to receive the swap control signal CTRL2, a first terminal to receive the second data voltage, and a second terminal connected to the first data line.

In an example embodiment, the first and third swap transistors may be N-channel Metal Oxide Semiconductor (NMOS) transistors, and the second and fourth swap transistors may be P-channel Metal Oxide Semiconductor (PMOS) transistors. The first and third swap transistors may be turned-on and the second and fourth swap transistors may be turned-off when the swap control signal CTRL2 has a first voltage level. Also, the first and third swap transistors may be turned-off and the second and fourth swap transistors may be turned-on when the swap control signal CTRL2 has a second voltage level lower than the first voltage level.

In another example embodiment, the first and third swap transistors may be the PMOS transistors, and the second and fourth swap transistors may be the NMOS transistors. The first and third swap transistors may be turned-off and the second and fourth swap transistors may be turned-on when the swap control signal CTRL2 has the first voltage level. Also, the first and third swap transistors may be turned-on and the second and fourth swap transistors may be turned-off when the swap control signal CTRL2 has the second voltage level. There will be a detailed example in which the first through fourth swap transistors swap the first through third data voltages in FIG. 4 below.

In example embodiments, the data lines DL(1) through DL(n) may include a first data line, a second data line, a third data line, and a fourth data line. The data voltage swapper may swap a first data voltage supplied to the first data line with a fourth data voltage supplied to the fourth data line based on the swap control signal CTRL2. The data voltage swapper may swap a second data voltage supplied to the second data line with a third data voltage supplied to the third data line based on the swap control signal CTRL2. In example embodiments, the first data line may be connected to the red pixel emitting red light, the second data line may be connected to the green pixel emitting green light, the third data line may be connected to the blue pixel emitting blue light, and the fourth data line may be connected to a white pixel emitting white light. For example, the data voltage generator may generate the data voltages DV(1) through DV(n) to have one of voltages of about 1V, about 3V, about 5V and about 7V. The data voltages applied to the first through fourth data lines may be different according to a color a given pixel is to emit.

In example embodiments, the data lines DL(1) through DL(n) may include a first data line and a second data line. The data voltage swapper may swap a first data voltage supplied to the first data line with a second data voltage supplied to the second data line based on the swap control signal CTRL2. In example embodiments, the first data line may be connected to the red pixel emitting red light and the blue pixel emitting blue light, and the second data line may be connected to the green pixel emitting green light.

In example embodiments, the data voltage generator may generate the data voltages DV(1) through DV(n) by selecting one of candidate data voltages. For example, the data voltage generator may select a data voltage candidate of about 8V as a first data voltage that drives a first pixel to emit green light. Also, the data voltage generator may select the data voltage candidate of about 10V as a second data voltage among the candidate data voltages of about 2V, about 4V, about 6V, about 8V and about 10V. The second date voltage may drive a second pixel to emit red light. Moreover, the data voltage generator may select the data voltage candidate of about 2V as an n-th data voltage. As a result, the data voltage generator may generate the data voltages DV(1) through DV(n) based on the selected candidate data voltages of about 8V, about 10V, about 2V, etc.

In example embodiments, the candidate data voltages may include a red activation voltage, a green activation voltage, a blue activation voltage, and a deactivation voltage. In the digital driving technique, the data voltages DV(1) through DV(n) may include activation voltages corresponding to '1' and the deactivation voltage corresponding to '0'. The activation voltages may differ according to light color emitted by the pixels. For example, the red activation voltage may be about 7V, the green activation voltage may be about 3V, and the blue activation voltage may be about 2V. For example, the red pixel may emit the red light when the red activation voltage is applied to the red pixel. In contrast, deactivation voltages of the pixels may be the same regardless of the light color. For example, the deactivation voltage may be about 0V.

In example embodiments, the candidate data voltages may include a pre-emphasis voltage. Here, the pre-emphasis voltage may reduce a required time in which the red, green and blue activation voltages are supplied to the pixels. The data lines DL(1) through DL(n) may have resistances. Therefore, an RC delay may occur in which the data voltages DV(1) through DV(n) are supplied to the pixels. Thus, the pre-emphasis voltage may have a voltage level pre-emphasizing the activation voltages. That is, a voltage difference between the pre-emphasis voltage and the deactivation voltage may be greater than a voltage difference between one of the activation voltages and the deactivation voltage. For example, the pre-emphasis voltage may be about 10V when the deactivation voltage is about 0V and the activation voltages of each pixel are about 7V, about 3V, and about 2V. The pre-emphasis voltage may be supplied to the data lines DL(1) through DL(n) during a predetermined period prior to a period in which the activation voltage is supplied to the data lines DL(1) through DL(n). The required time in which the activation voltage is supplied to the pixels 115 may be reduced by supplying the pre-emphasis voltage to the data lines DL(1) through DL(n).

The timing controller 150 may control the scan driver 120, the first data driver 130, and the second data driver 140. The timing controller 150 may generate the data control signal CTRL1, the swap control signal CTRL2 and a scan control signal CTRL3. The timing controller 150 may control the first data driver 130 and the second data driver 140 based on the data control signal CTRL1 and the swap control signal CTRL2. Also, the timing controller 150 may control the scan driver 120 based on the scan control signal CTRL3.

As a result, at least one of the first and second data drivers 130 and 140 having substantially the same structure may swap at least two of the data voltages DV(1) through DV(n) based on the swap control signal CTRL2 and supply the swapped data voltages to the data lines DL(1) through DL(n). Therefore, both ends of each data line (e.g., DL(1) through DL(n)) may receive substantially the same data voltages (e.g., DV(1) through DV(n) of FIG. 1), respectively. Further, the first and second data drivers 130 and 140 may supply substantially the same data voltage to the same data line so that the delay of data voltage charging time may be reduced or prevented.

Figure 2:
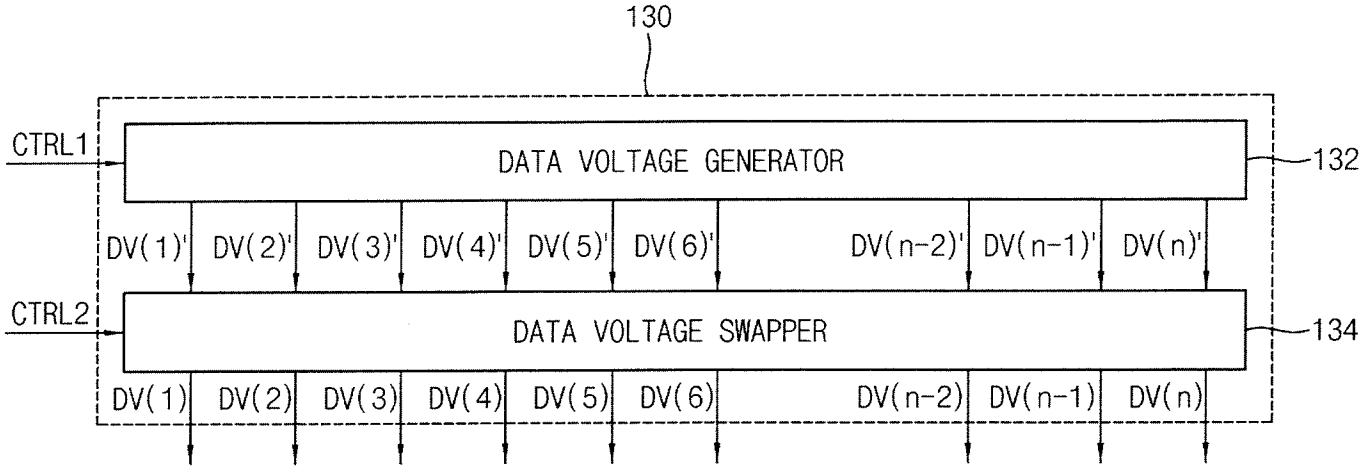
FIG. 2 illustrates a block diagram of an example of a first data driver included in the display device of FIG. 1.

FIG. 2 illustrates a block diagram of an example of the first data driver 130 included in the display device of FIG. 1. Referring to FIG. 2, the first data driver 130 may include a data voltage generator 132 and a data voltage swapper 134.

The data voltage generator 132 may generate data voltages DV(1)' through DV(n)'. In detail, the data voltage generator 132 may generate the data voltages DV(1)' through DV(n)' based on a data control signal CTRL1. The number of the data voltages DV(1)' through DV(n)' may be substantially the same as the number of data lines. The data voltages DV(1)' through DV(n)' may be applied to first to n-th data lines, respectively.

The data voltage swapper 134 may swap the data voltages DV(1)' through DV(n)' generated by the data voltage generator 132 based on a swap control signal CTRL2 and supply the swapped data voltages DV(1) through DV(n) to the data lines. That is, the data lines may receive the swapped data voltages DV(1) through DV(n). In detail, the data voltage swapper 134 may swap at least two of the data voltages DV(1)' through DV(n)' based on the swap control signal CTRL2. The data voltage swapper 134 may selectively swap the data voltages DV(1)' through DV(n)'. For example, the data voltage swapper 134 may swap a red data voltage with a blue data voltage and the data voltage swapper 134 may not swap a green data voltage.

Figure 3:
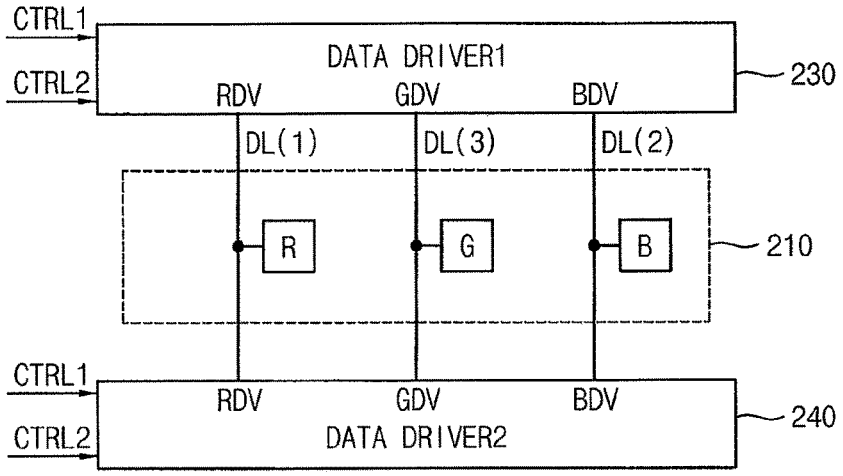
FIG. 3 illustrates a diagram of an example in which a first data driver and a second data driver included in the display device of FIG. 1 supply data voltages through data lines.

FIG. 3 illustrates a diagram of an example in which a first data driver 230 and a second data driver 240 included in the display device of FIG. 1 supply data voltages through data lines to a display panel 210. Referring to FIG. 3, the first data driver 230 and the second data driver 240 may supply a red data voltage RDV to a red pixel R, a green data voltage GDV to a green pixel G, and a blue data voltage BDV to a blue pixel B included in the display panel 210.

Each of the first and second data drivers 230 and 240 may include a data voltage generator and a data voltage swapper. The data voltage generator may generate the data voltages RDV, GDV, and BDV based on a data control signal CTRL1. The data voltage swapper may swap the data voltages RDV, GDV, and BDV based on a swap control signal CTRL2, and supply the swapped data voltages to the data lines DL(1), DL(2), and DL(3).

The data voltage swapper included in the first data driver 230 may be operated differently with the data voltage swapper included in the second data driver 240 to supply substantially the same data voltages RDV, GDV and BDV to both ends of the data lines DL(1), DL(2), and DL(3). For example, the data voltage swapper included in the first data driver 230 may not perform a swap operation and the data voltage swapper included in the second data driver 240 may perform a swap operation. Therefore, both ends of the data lines DL(1), DL(2), and DL(3) may receive the substantially the same data voltages RDV, GDV and BDV, respectively. In other words, the data voltage RDV output from the first data driver 230 may be applied to a first end of a first data line DL(1). The data voltage RDV output from the second data driver 240 may be applied to a second end of the first data line DL(1). The data voltages RDV at both ends of the first data line DL(1) may be substantially the same.

The data lines DL(1), DL(2), and DL(3) may include the first data line DL(1), a second data line DL(2), and a third data line DL(3). The third data line DL(3) may be between the first data line DL(1) and the second data line DL(2). The data voltage swapper included in the second data driver 240, contrary to the data voltage swapper included in the first data driver 230, may swap a first data voltage RDV supplied to the first data line DL(1) with a second data voltage BDV supplied to the second data line DL(2) based on the swap control signal CTRL2. The data voltage swapper included in the second data driver 240 may not swap a third data voltage GDV supplied to the third data line DL(3). In an example embodiment, the first data line DL(1) may be connected to the red pixel R emitting red light, the second data line DL(2) may be connected to the blue pixel B emitting blue light, and the third data line DL(3) may be connected to the green pixel G emitting green light. In another example embodiment, the first data line may be connected to the green pixel emitting green light, the second data line may be connected to the red pixel emitting red light and the third data line may be connected to the blue pixel emitting blue light. In still another example embodiment, the first data line may be connected to the blue pixel emitting blue light, the second data line may be connected to the green pixel emitting green light and the third data line may be connected to the red pixel emitting red light.

Figure 4:
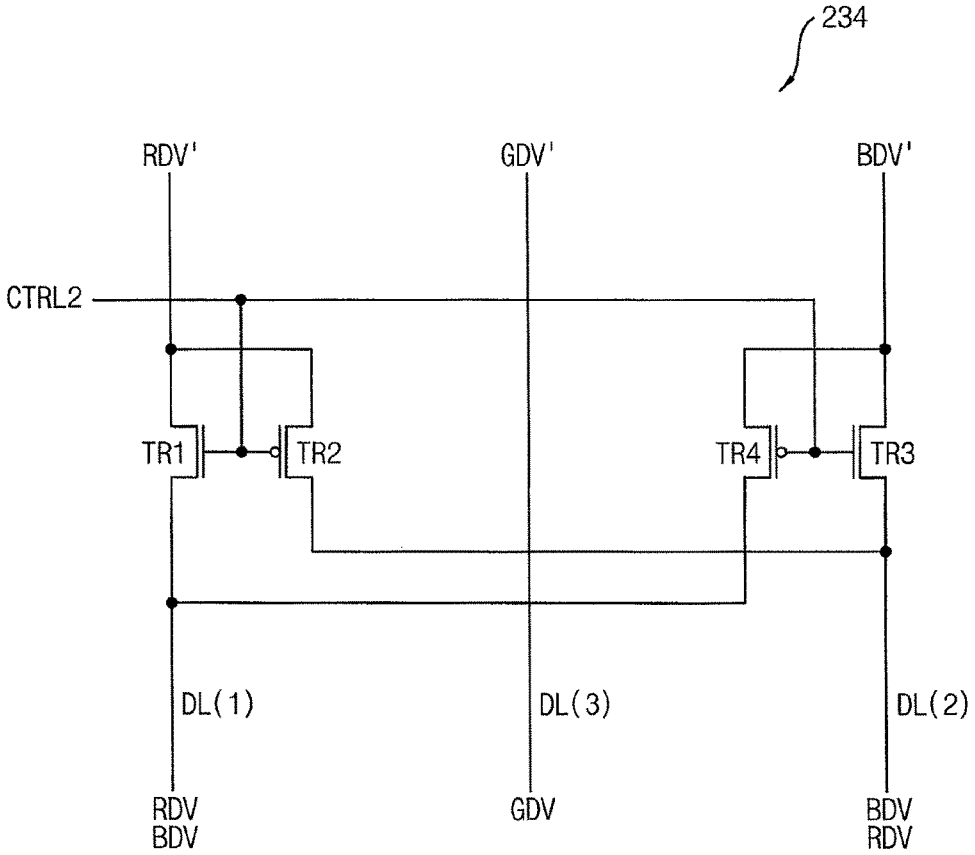
FIG. 4 illustrates a circuit diagram of an example of a data voltage swapper included in the display device of FIG. 1.

FIG. 4 illustrates a circuit diagram of an example of a data voltage swapper included in the display device of FIG. 1.

Referring to FIG. 4, the data voltage swapper 234 may include a first swap transistor TR1, a second swap transistor TR2, a third swap transistor TR3, and a fourth swap transistor TR4. The first swap transistor TR1 may include a gate terminal, a first terminal, and a second terminal. The gate terminal may receive a swap control signal CTRL2. The first terminal may receive a first data voltage RDV'. The second terminal may be connected to a first data line DL(1). The second swap transistor TR2 may include a gate terminal, a first terminal, and a second terminal. The gate terminal may receive the swap control signal CTRL2. The first terminal may receive the first data voltage RDV'. The second terminal may be connected to a second data line DL(2). The third swap transistor TR3 may include a gate terminal, a first terminal, and a second terminal. The gate terminal may receive the swap control signal CTRL2. The first terminal may receive a second data voltage BDV'. The second terminal may be connected to the second data line DL(2). The fourth swap transistor TR4 may include a gate terminal, a first terminal, and a second terminal. The gate terminal may receive the swap control signal CTRL2. The first terminal may receive the second data voltage BDV'. The second terminal may be connected to the first data line DL(1).

In an example embodiment, the first swap transistor TR1 and the third swap transistor TR3 may be N-channel Metal Oxide Semiconductor (NMOS) transistors, and the second swap transistor TR2 and the fourth swap transistor TR4 may be P-channel Metal Oxide Semiconductor (PMOS) transistors. The first and third swap transistors may be turned-on and the second and fourth swap transistors may be turned-off when the swap control signal CTRL2 has a first voltage level. In this case, a first data voltage RDV may be supplied to the first data line DL(1) and a second data voltage BDV may be supplied to the second data line DL(2). Also, the first and third swap transistors may be turned-off and the second and fourth swap transistors may be turned-on when the swap control signal CTRL2 has a second voltage level lower than the first voltage level. In this case, the second data voltage BDV may be supplied to the first data line DL(1) and the first data voltage RDV may be supplied to the second data line DL(2). That is, the first data voltage RDV and the second data voltage BDV may be swapped and supplied to the first data line DL(1) and the second data line DL(2), respectively.

In another example embodiment, the first and third swap transistors may be PMOS transistors, and the second and fourth swap transistors may be NMOS transistors. The first and third swap transistors may be turned-off and the second and fourth swap transistors may be turned-on when the swap control signal has the first voltage level. In this case, the second data voltage may be supplied to the first data line and the first data voltage may be supplied to the second data line. That is, the first data voltage and the second data voltage may be swapped and supplied to the first data line and the second data line, respectively. Also, the first and third swap transistors may be turned-on and the second and fourth swap transistors may be turned-off when the swap control signal has the second voltage level. In this case, the first data voltage may be supplied to the first data line and the second data voltage may be supplied to the second data line.

Figure 5:
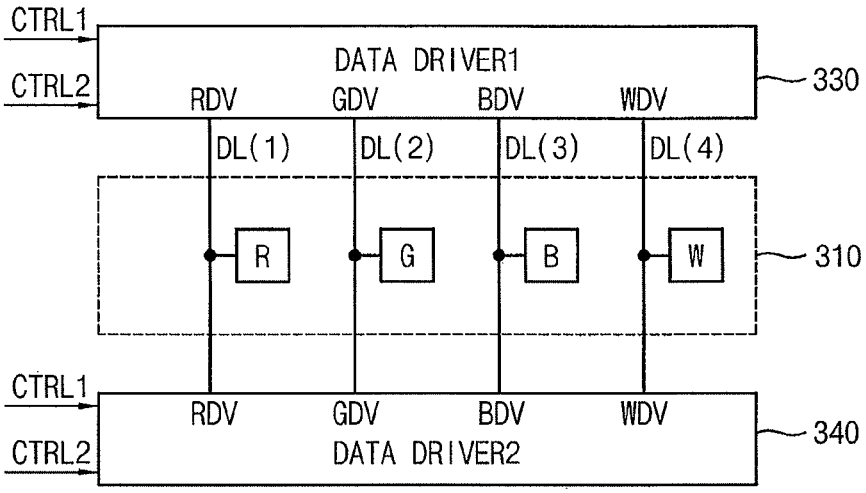
FIG. 5 illustrates a diagram of another example in which a first data driver and a second data driver included in the display device of FIG. 1 supply data voltages through data lines.

FIG. 5 illustrates a diagram of another example in which a first data driver and a second data driver included in the display device of FIG. 1 supply data voltages through data lines.

Referring to FIG. 5, a first data driver 330 and a second data driver 340 may supply data voltages to pixels in a display panel 310. In particular, the first data driver 330 and the second data driver 340 may supply, a red data voltage RDV to a red pixel R, a green data voltage GDV to a green pixel G, a blue data voltage BDV to a blue pixel B, and a white data voltage WDV to a white pixel W included in the display panel 310.

Each of the first and second data drivers 330 and 340 may include a data voltage generator and a data voltage swapper. The data voltage generator may generate the data voltages based on a data control signal CTRL1. The data voltage swapper may swap the data voltages RDV, GDV, BDV, and WDV based on a swap control signal CTRL2 and supply the swapped data voltages to the data lines DL(1) through DL(4).

The data voltage swapper included in the first data driver 330 may be operated differently with the data voltage swapper included in the second data driver 340 to supply substantially the same data voltages RDV, GDV, BDV, and WDV to both ends of the data lines DL(1) through DL(4). For example, the data voltage swapper included in the first data driver 330 may not perform a swap operation and the data voltage swapper included in the second data driver 340 may perform the swap operation. Therefore, both ends of the data lines DL(1) through DL(4) may receive the substantially the same data voltages RDV, GDV, BDV and WDV, respectively. For example, the data voltage RDV output from the first data driver 330 may be applied to a first end of a first data line DL(1). The data voltage RDV output from the second data driver 340 may be applied to a second end of the first data line DL(1). The data voltages RDV at both ends of the first data line DL(l) may be substantially the same.

The data lines DL(1) through DL(4) may include the first data line DL(1), a second data line DL(2), a third data line DL(3), and a fourth data line DL(4). The data voltage swapper included in the second data driver 340, contrary to the data voltage swapper included in the first data driver 330, may swap a first data voltage RDV supplied to the first data line DL(1) with a fourth data voltage WDV supplied to the fourth data line DL(4) based on the swap control signal CTRL2. The data voltage swapper included in the second data driver 340, contrary to the data voltage swapper included in the first data driver 330, may swap a second data voltage GDV supplied to the second data line DL(2) with a third data voltage BDV supplied to the third data line DL(3) based on the swap control signal CTRL2. In example embodiments, the first data line DL(1) may be connected to the red pixel R emitting red light, the second data line DL(2) may be connected to the green pixel G emitting green light, the third data line DL(3) may be connected to the blue pixel B emitting blue light, and the fourth data line DL(4) may be connected to the white pixel W emitting white light.

Figure 6:
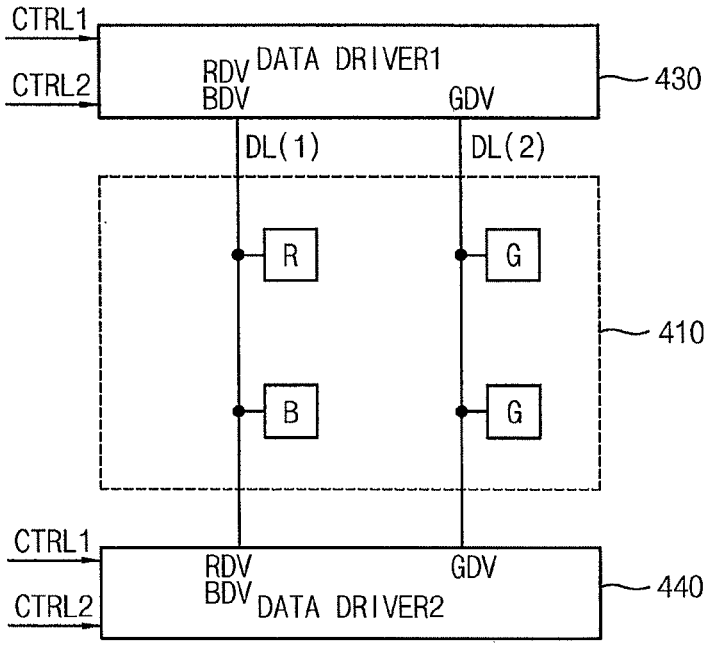
FIG. 6 illustrates a diagram of still another example in which a first data driver and a second data driver included in the display device of FIG. 1 supply data voltages through data lines.

FIG. 6 is a diagram illustrating still another example in which a first data driver and a second data driver included in the display device of FIG. 1 supply data voltages through data lines.

Referring to FIG. 6, the first data driver 430 and the second data driver 440 may supply data voltages to a display panel 410. The first data driver 430 and the second data driver 440 may supply a red data voltage RDV to a red pixel R, a green data voltage GDV to a green pixel G, and a blue data voltage BDV to a blue pixel B included in the display panel 410.

Each of the first and second data drivers 430 and 440 may include a data voltage generator and a data voltage swapper. The data voltage generator may generate the data voltages based on a data control signal CTRL1. The data voltage swapper may swap the data voltages RDV, GDV and BDV based on a swap control signal CTRL2 and supply the swapped data voltages to the data lines DL(1) and DL(2).

The data voltage swapper included in the first data driver 430 may be operated differently with the data voltage swapper included in the second data driver 440 to supply substantially the same data voltages RDV, GDV and BDV to both ends of the data lines DL(1) and DL(2). For example, the data voltage swapper included in the first data driver 430 may not perform a swap operation and the data voltage swapper included in the second data driver 440 may perform the swap operation. Therefore, the both ends of the data lines DL(1) and DL(2) may receive the substantially the same data voltages RDV, GDV, and BDV, respectively. For example, the data voltage RDV output from the first data driver 430 may be applied to a first end of a first data line DL(1). The data voltage RDV output from the second data driver 440 may be applied to second end of the first data line DL(1). The data voltages RDV at both ends of the first data line DL(1) may be substantially the same.

The data lines DL(1) and DL(2) may include the first data line DL(1) and a second data line DL(2) adjacent to each other. The data voltage swapper included in the second data driver 440, contrary to the data voltage swapper included in the first data driver 430, may swap a first data voltage RDV and BDV supplied to the first data line DL(1) with a second data voltage GDV supplied to the second data line DL(2) based on the swap control signal CTRL2. In example embodiments, the first data line DL(1) may be connected to the red pixel R emitting red light and the blue pixel B emitting blue light, and the second data line DL(2) may be connected to the green pixel G emitting green light.

Although a few example embodiments of the data driver and a display device having the data driver have been described with reference to the figures, those skilled in the art will readily appreciate that many modifications are possible in the example embodiments without materially departing from the novel teachings and advantages of the disclosure. For example, although it is described above that the first and second data drivers are connected to the each ends of the data lines, the each ends is not limited to physical ends of the data lines, but the each ends may be substantive ends of the data lines on functional aspects.

The embodiments may be applied to any electronic device including a display device. For example, the embodiments may be applied to a computer, a laptop, a digital camera, a video camcorder, a cellular phone, a smart phone, a smart pad, a PMP, a PDA, an MP3 player, a navigation system, a video phone, a monitoring system, a tracking system, a motion detecting system, an image stabilization system, etc.

By way of summation and review, some example embodiments provide a display device preventing a delay on a charging time of data voltages, while some example embodiments provide a data driver included in the display device. In particular delay of data voltage charging time may be reduced or prevented by including a first data driver connected to a first end of each data line and second data driver connected to the a second end of each data line. In addition, at least one of the first and second data drivers according to example embodiments may swap the data voltages and supply the swapped data voltages to the data lines so that both ends of each data line may receive substantially the same data voltage. Further, the first and second data drivers may supply substantially the same data voltage to the same data line so that the delay of data voltage charging time may be reduced or prevented.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including a plurality of pixels;

a scan driver to supply scan signals to the pixels;

a first data driver connected to first ends of data lines, the first data driver to supply data voltages to the pixels through the data lines during an active period of the scan signals;

a second data driver connected to second ends of the data lines, the second data driver to supply the data voltages to the pixels through the data lines during the active period of the scan signals; and a timing controller to control the scan driver, the first data driver, and the second data driver, wherein the first data driver and the second data driver are to swap at least two of the data voltages based on a swap control signal and supply the swapped data voltages to the data lines, wherein each of the first and second data drivers includes:

a data voltage generator to generate the data voltages; and a data voltage swapper to swap the data voltages based on the swap control signal and supply the swapped data voltages to the data lines, and wherein the data voltage swapper includes:

a first swap transistor including a gate terminal to receive the swap control signal, a first terminal to receive a first one of the data voltages, and a second terminal connected to a first one of the data lines;

a second swap transistor including a gate terminal to receive the swap control signal, a first terminal to receive the first one of the data voltages, and a second terminal connected to a second one of the data lines;

a third swap transistor including a gate terminal to receive the swap control signal, a first terminal to receive a second one of the data voltages, and a second terminal connected to the second one of the data lines; and a fourth swap transistor including a gate terminal to receive the swap control signal, a first terminal to receive the second one of the data voltages, and a second terminal connected to the first one of the data lines.

2. The display device as claimed in claim 1, wherein the data lines include first through n-th data lines adjacent to each other, where n is an integer greater than or equal to 2, and wherein the data voltage swapper is to swap the at least two of the data voltages based on the swap control signal and to supply the swapped data voltages to the first through n-th data lines.

3. The display device as claimed in claim 2, wherein the data voltage swapper is to swap a k-th data voltage supplied to a k-th data line with an (n−k+1)-th data voltage supplied to an (n−k+1)-th data line among the data voltages, where k is a positive integer less than or equal to n.

4. The display device as claimed in claim 1, wherein the data lines include a first data line, a second data line, and a third data line between the first data line and the second data line, and wherein the data voltage swapper is to swap a first data voltage supplied to the first data line with a second data voltage supplied to the second data line among the data voltages based on the swap control signal.

5. The display device as claimed in claim 4, wherein the first data line is connected to a red pixel emitting red light, the second data line is connected to a blue pixel emitting blue light, and the third data line is connected to a green pixel emitting green light.

6. The display device as claimed in claim 1, wherein the first and third swap transistors are N-channel Metal Oxide Semiconductor (NMOS) transistors, and the second and fourth swap transistors are P-channel Metal Oxide Semiconductor (PMOS) transistors.

7. The display device as claimed in claim 6, wherein the first and third swap transistors are turned-on and the second and fourth swap transistors are turned-off when the swap control signal has a first voltage level, and wherein the first and third swap transistors are turned-off and the second and fourth swap transistors are turned-on when the swap control signal has a second voltage level lower than the first voltage level.

8. The display device as claimed in claim 1, wherein the data lines include a first data line, a second data line, a third data line, and a fourth data line adjacent to each other, and wherein the data voltage swapper is to swap a first data voltage supplied to the first data line with a fourth data voltage supplied to the fourth data line among the data voltages based on the swap control signal, and the data voltage swapper is to swap a second data voltage supplied to the second data line with a third data voltage supplied to the third data line among the data voltages based on the swap control signal.

9. The display device as claimed in claim 8, wherein the first data line is connected to a red pixel emitting red light, the second data line is connected to a green pixel emitting green light, the third data line is connected to a blue pixel emitting blue light, and the fourth data line is connected to a white pixel emitting white light.

10. The display device as claimed in claim 1, wherein the data lines include a first data line and a second data line adjacent to each other, and wherein the data voltage swapper is to swap a first data voltage supplied to the first data line with a second data voltage supplied to the second data line among the data voltages based on the swap control signal.

11. The display device as claimed in claim 10, wherein the first data line is connected to a red pixel emitting red light and a blue pixel emitting blue light, and the second data line is connected to a green pixel emitting green light.

12. The display device as claimed in claim 1, wherein the data voltage generator is to generate the data voltages by selecting one of candidate data voltages.

13. The display device as claimed in claim 12, wherein the candidate data voltages include a red activation voltage, a green activation voltage, a blue activation voltage, and a deactivation voltage.

14. The display device as claimed in claim 13, wherein the candidate data voltages include a pre-emphasis voltage to reduce a required time in which the red activation voltage, the green activation voltage, and the blue activation voltage are supplied to the pixels.

15. A data driver, comprising:

a data voltage generator to generate data voltages; and a data voltage swapper to swap the data voltages based on a swap control signal and to supply the swapped data voltages to data lines, wherein the data voltage swapper includes:

a first swap transistor including a gate terminal to receive the swap control signal, a first terminal to receive a first one of the data voltages, and a second terminal connected to a first one of the data lines;

a second swap transistor including a gate terminal to receive the swap control signal, a first terminal to receive the first one of the data voltages, and a second terminal connected to a second one of the data lines;

a third swap transistor including a gate terminal to receive the swap control signal, a first terminal to receive a second one of the data voltages, and a second terminal connected to the second one of the data lines; and a fourth swap transistor including a gate terminal to receive the swap control signal, a first terminal to receive the second one of the data voltages, and a second terminal connected to the first one of the data lines.

16. The data driver as claimed in claim 15, wherein the data lines include first through n-th data lines adjacent to each other, where n is an integer greater than or equal to 2, and wherein the data voltage swapper is to swap at least two of the data voltages based on the swap control signal and to supply the swapped data voltages to the first through n-th data lines.

17. The data driver as claimed in claim 16, wherein the data voltage swapper is to swap a k-th data voltage supplied to a k-th data line with an (n−k+1)-th data voltage supplied to an (n−k+1)-th data line among the data voltages, where k is a positive integer less than or equal to n.

18. The data driver as claimed in claim 15, wherein the data lines include a first data line, a second data line, and a third data line between the first data line and the second data line, and wherein the data voltage swapper is to swap a first data voltage supplied to the first data line with a second data voltage supplied to the second data line among the data voltages based on the swap control signal.

* * * * *